US012465149B2

(12) United States Patent
Sha

(10) Patent No.: US 12,465,149 B2
(45) Date of Patent: Nov. 11, 2025

(54) ZERO-WALL TRIFOLD SOFA BED

(71) Applicant: Omega Smart Home (Jiangsu) Co., Ltd., Taizhou (CN)

(72) Inventor: Jianbo Sha, Taizhou (CN)

(73) Assignee: OMEGA SMART HOME (JIANGSU) CO., LTD., Taizhou (CN)

( * ) Notice: Subject to any disclaimer, the term of this patent is extended or adjusted under 35 U.S.C. 154(b) by 276 days.

(21) Appl. No.: 18/377,837

(22) Filed: Oct. 9, 2023

(65) Prior Publication Data

US 2025/0040721 A1 Feb. 6, 2025

(30) Foreign Application Priority Data

Aug. 2, 2023 (CN) ..... 202310964474.7

(51) Int. Cl.
*A47C 17/17* (2006.01)
*A47C 17/175* (2006.01)

(52) U.S. Cl.
CPC ..... *A47C 17/1756* (2013.01)

(58) Field of Classification Search
CPC ... A47C 17/17; A47C 17/1753; A47C 17/175; A47C 17/1756; A47C 17/22; A47C 17/20; A47C 17/16; A47C 17/13
See application file for complete search history.

(56) References Cited

U.S. PATENT DOCUMENTS 795,783 A * 7/1905 Walker ..... A47C 17/2076 5/52
1,775,672 A * 9/1930 Duvall ..... A47C 17/22 5/56
2,136,320 A * 11/1938 Schwab, Jr. ..... A47C 17/17 5/47
3,456,268 A * 7/1969 Rogers, Jr. ..... A47C 17/22 5/28
3,634,893 A * 1/1972 Hern ..... A47C 17/17 5/47
3,906,558 A * 9/1975 Alembik ..... A47C 17/22 297/118
5,083,333 A * 1/1992 Newton ..... A47C 17/1753 5/47
7,549,182 B2 * 6/2009 Murphy ..... A47C 17/20 5/42

(Continued)

FOREIGN PATENT DOCUMENTS

CN 216675265 U 6/2022

*Primary Examiner* — Adam C Ortiz
*Assistant Examiner* — Ifeolu A Adeboyejo
(74) *Attorney, Agent, or Firm* — Bayramoglu Law Offices LLC

(57) ABSTRACT

A zero-wall trifold sofa bed includes a sofa base, where the sofa base is provided with two symmetrical folding assemblies; the folding assemblies each include a first long arm and a second long arm that are pivoted to a front side of an inner wall of an armrest box of the sofa base; the first long arm and the second long arm are jointly pivoted to a first assembly element for assembling a first sofa base; a middle part of the first long arm is provided with a first short arm; a middle part of the second long arm is provided with a second short arm and a third short arm; the first short arm and the second short arm are jointly pivoted to a second assembly element for assembling a second sofa base; the third short arm is pivoted to one end of a connecting rod.

8 Claims, 9 Drawing Sheets

(56) References Cited

U.S. PATENT DOCUMENTS

| | | | | |
|---|---|---|---|---|
| 8,438,676 | B2 * | 5/2013 | Murphy | A47C 3/16 5/28 |
| 2003/0070225 | A1 * | 4/2003 | Murphy | A47C 17/2076 5/13 |
| 2016/0051057 | A1 * | 2/2016 | Murphy | A47C 17/2073 5/29 |
| 2021/0315387 | A1 * | 10/2021 | Williams | A47C 17/161 |
| 2022/0160136 | A1 * | 5/2022 | Jablonski | A47C 17/13 |

* cited by examiner

ZERO-WALL TRIFOLD SOFA BED

CROSS REFERENCE TO THE RELATED APPLICATIONS

This application is based upon and claims priority to Chinese Patent Application No. 202310964474.7, filed on Aug. 2, 2023, the entire contents of which are incorporated herein by reference.

TECHNICAL FIELD

The present disclosure relates to the field of household furniture manufacturing, and in particular to a zero-wall trifold sofa bed.

BACKGROUND

Chinese patent application CN216675265U provides a foldable single sofa bed. When the foldable single sofa bed is completely converted into a bed, a second seat cushion is pulled out horizontally through a pulley guide rail, a handle is pulled up to support the second seat cushion through a support frame such that the second seat cushion is flush with the first seat cushion, and finally a backrest is laid flat backward through a hinge. The foldable single sofa bed requires a cumbersome multi-step operation, and cannot be placed against the wall, wasting space.

SUMMARY

In view of the shortcomings of the prior art, an objective of the present disclosure is to provide a zero-wall trifold sofa bed that is easy to operate and improves space utilization.

In order to achieve the above objective, the zero-wall trifold sofa bed of the present disclosure adopts the following technical solution.

The zero-wall trifold sofa bed includes a sofa base, where the sofa base is provided with two symmetrical folding assemblies; the folding assemblies each include a first long arm and a second long arm that are pivoted to a front side of an inner wall of an armrest box of the sofa base; the first long arm and the second long arm are jointly pivoted to a first assembly element for assembling a first sofa base; a middle part of the first long arm is provided with a first short arm; a middle part of the second long arm is provided with a second short arm and a third short arm; the first short arm and the second short arm are jointly pivoted to a second assembly element for assembling a second sofa base; the third short arm is pivoted to one end of a connecting rod, and the other end of the connecting rod is pivoted to one end of a third assembly element for assembling a backrest; the other end of the third assembly element is pivoted to one end of a pull rod, and the other end of the pull rod is pivoted to a back side of the inner wall of the armrest box of the sofa base; a side of the third assembly element close to the connecting rod is provided with a roller; and the inner wall of the armrest box of the sofa base is provided with a horizontal sliding groove for the roller to slide.

Preferably, the front side of the inner wall of the armrest box of the sofa base is provided with a first base that is pivoted to the first long arm and the second long arm; and the back side of the inner wall of the armrest box of the sofa base is provided with a second base that is pivoted to the pull rod.

Preferably, a first tension spring is provided between a tail end of the first base and a tail end of the first long arm; and a second tension spring is provided between a front part of the pull rod and a front part of the third assembly element.

Preferably, the pull rod is provided with a recess for avoiding the backrest.

Preferably, an outer wall of a front side of the first assembly element is provided with a first limit pin; an outer wall of a back side of the first assembly element is provided with a second limit pin; the first long arm is provided with a first limit surface matched with the first limit pin and a second limit surface matched with the second limit pin; and the second long arm is provided with a third limit surface matched with the second limit pin.

Preferably, a side of the third assembly element close to the pull rod is provided with a third limit pin; and the pull rod is provided with a fourth limit surface matched with the third limit pin.

Preferably, the first sofa base includes a first frame fixedly connected to the first assembly element; a top part of the first frame is provided with a first cushion; the second sofa base includes a second frame fixedly connected to the second assembly element; a top part of the second frame is provided with a second cushion; the backrest includes a backrest frame fixedly connected to the third assembly element; and a top part of the backrest frame is provided with a backrest cushion.

Preferably, a front side of the first frame is provided with a support element.

Compared with the prior art, the present disclosure has the following advantages:

1. In the present disclosure, the first sofa base is directly flipped to drive the first long arm and the second long arm to flip forward. The first long arm drives the first short arm to flip forward, while the second long arm drives the second short arm and the third short arm to flip forward. The first short arm and the second short arm flip out of the second sofa base. Meanwhile, the third short arm pulls the third assembly element through the connecting rod. The roller slides forwards inside the horizontal sliding groove, such that the upright backrest is flattened and spliced with the first sofa base and the second sofa base to form a bed. The present disclosure features easy one-step operation. The backrest does not need to be flipped backwards to allow the sofa base to be placed against a wall, improving space utilization and room layout aesthetics.

2. When the sofa is converted into a bed, the first tension spring and the second tension spring are stretched to provide a certain resistance, allowing the first sofa base to fall smoothly and safely. When the sofa is converted into a bed, the first tension spring and the second tension spring provide tension and a certain amount of support for the first long arm and the second long arm, thereby improving the stability of the folding mechanism after unfolding. When the bed is converted into a sofa, the first tension spring and the second tension spring are contracted, providing assistance for the first sofa base and the second sofa base to fold backward. In this way, the first sofa base and the second sofa base can be folded backward easily.

REFERENCE NUMERALS

Figure 1:
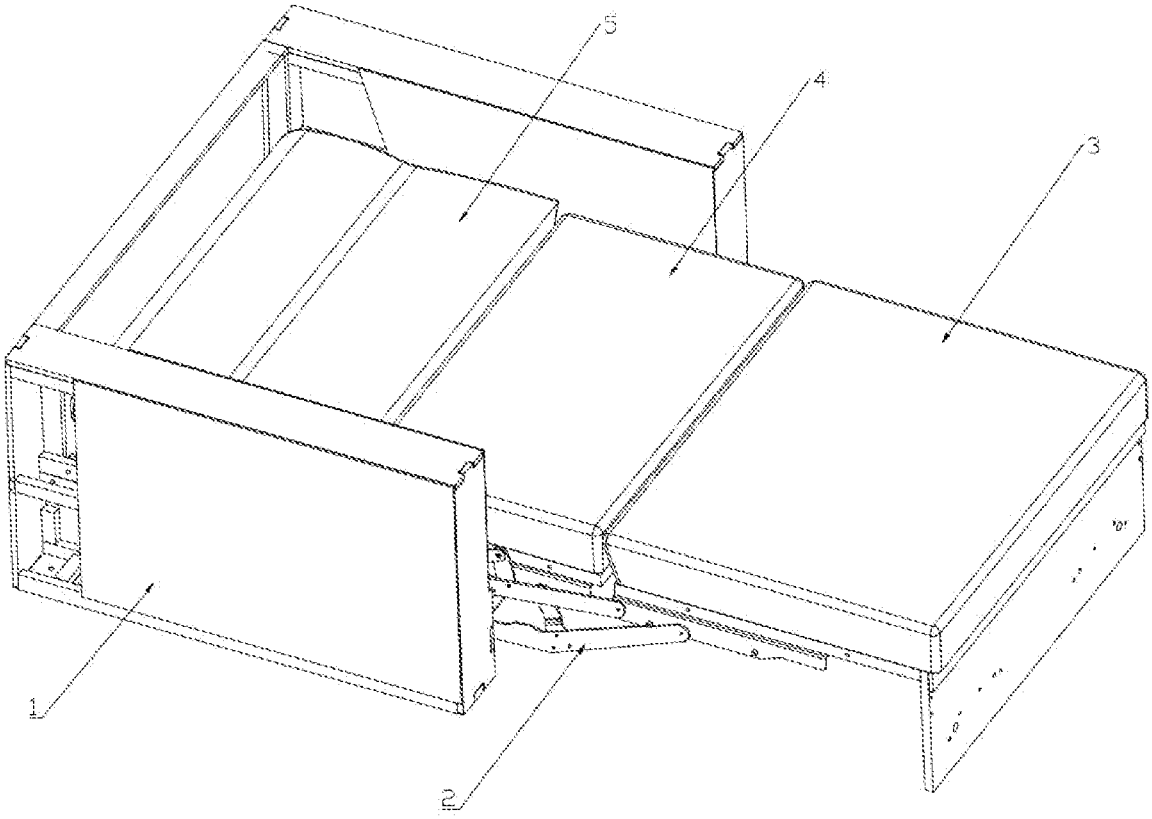
FIG. 1 is a structural diagram of a structure of a zero-wall trifold sofa bed according to the present disclosure.

1. sofa base; 11. first base; 111. second hanging pin; 12. second base; 13. guide rail; 131. horizontal sliding groove; 2. folding assembly; 21. first long arm, 211. first short arm; 212. first limit surface, 213. second limit surface; 214. first hanging pin; 22. second long arm; 221. U-shaped element; 2211. second short arm; 2212. third short arm; 222. third limit surface; 23. first assembly element; 231. first limit pin; 232. second limit pin; 24. second assembly element; 25. connecting rod; 26. third assembly element; 261. third limit pin; 262. roller; 263. support leg; 27. pull rod; 271. recess; 2711. fourth limit surface; 272. third hanging pin; 28. first tension spring; 29. second tension spring; 3. first sofa base; 31. first frame; 32. first cushion; 33. support element; 4. second sofa base; 41. second frame; 42. second cushion; 5. backrest; 51. backrest frame; and 52. backrest cushion.

DETAILED DESCRIPTION OF THE EMBODIMENTS

The present disclosure is further described below with reference to the drawing and specific implementations. It should be understood that these implementations are only intended to illustrate the present disclosure, rather than to limit the scope of the present disclosure. Modifications made to the equivalents of the present disclosure by those skilled in the art after reading the present disclosure should fall within the scope defined by the appended claims of the present disclosure.

Figure 2:
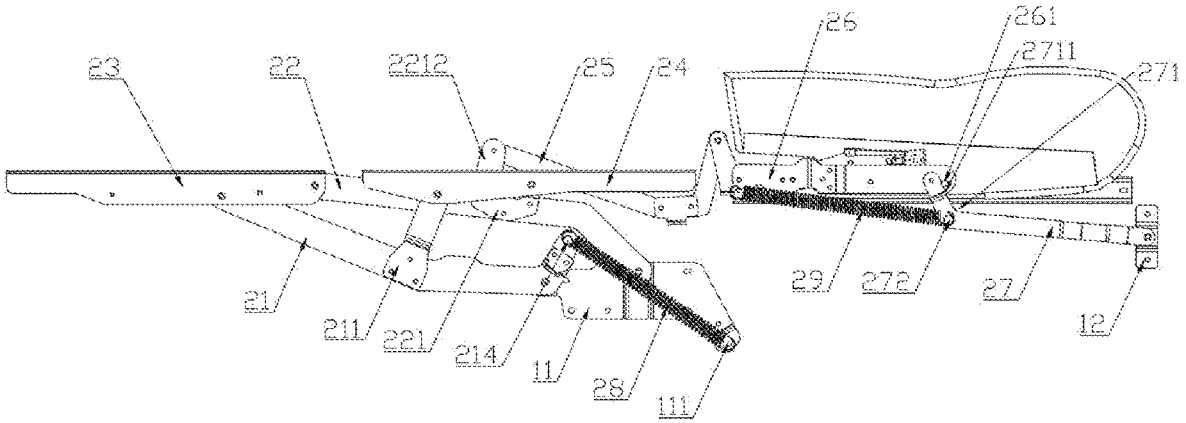
FIG. 2 is a front view of a folding assembly in an unfolded state.
Figure 3:
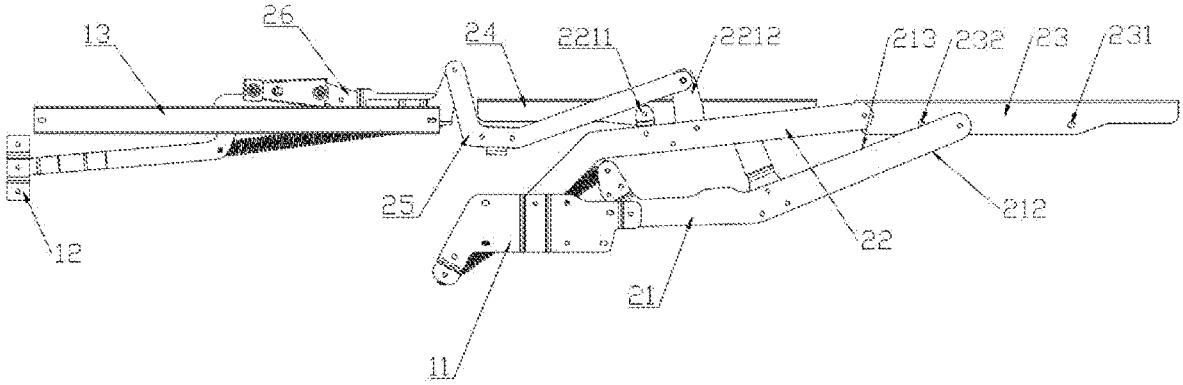
FIG. 3 is a back view of the folding assembly in the unfolded state.
Figure 4:
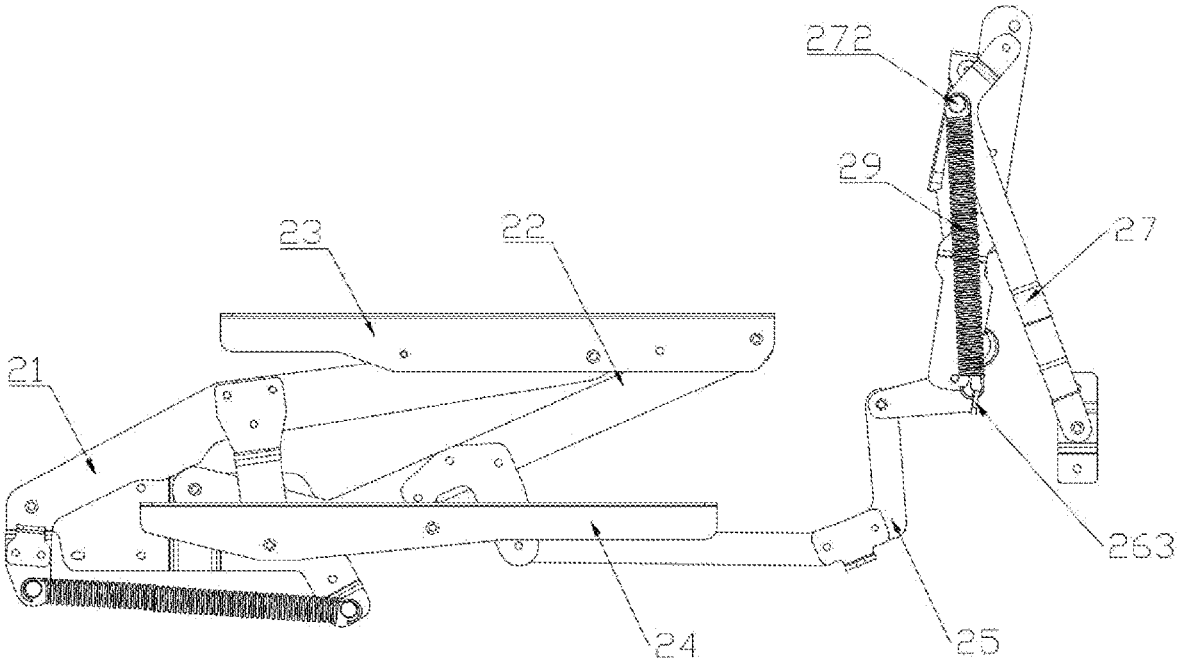
FIG. 4 is a front view of the folding assembly in a folded state.
Figure 5:
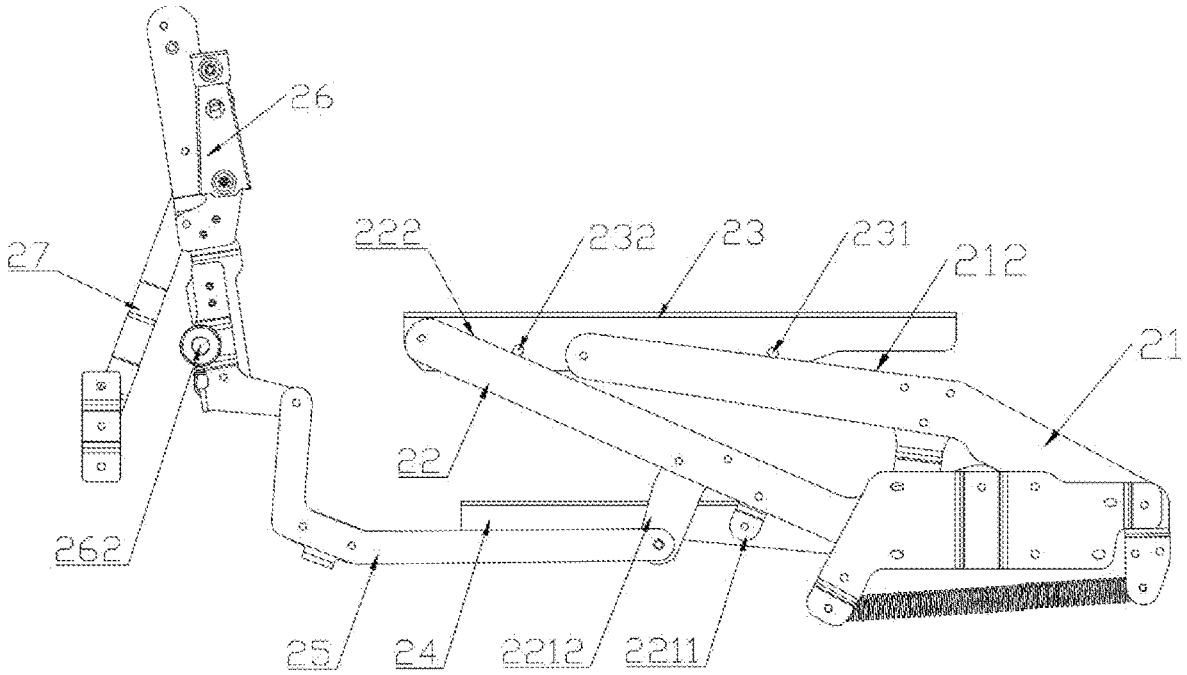
FIG. 5 is a back view of the folding assembly in the folded state.
Figure 6:
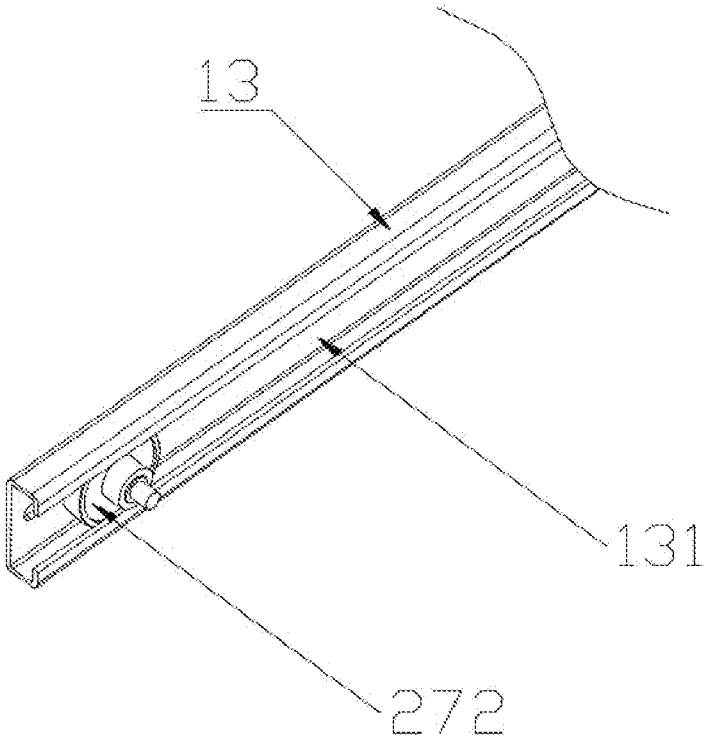
FIG. 6 is a structural diagram of a guide rail.
Figure 7:
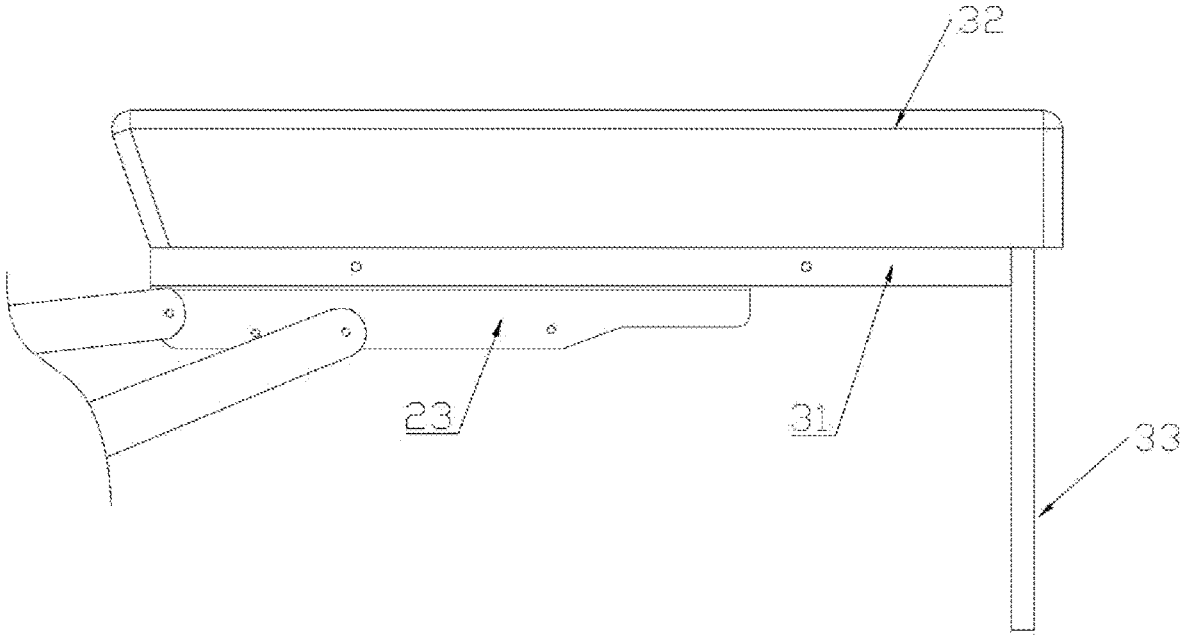
FIG. 7 is a structural diagram of a first sofa base.
Figure 8:
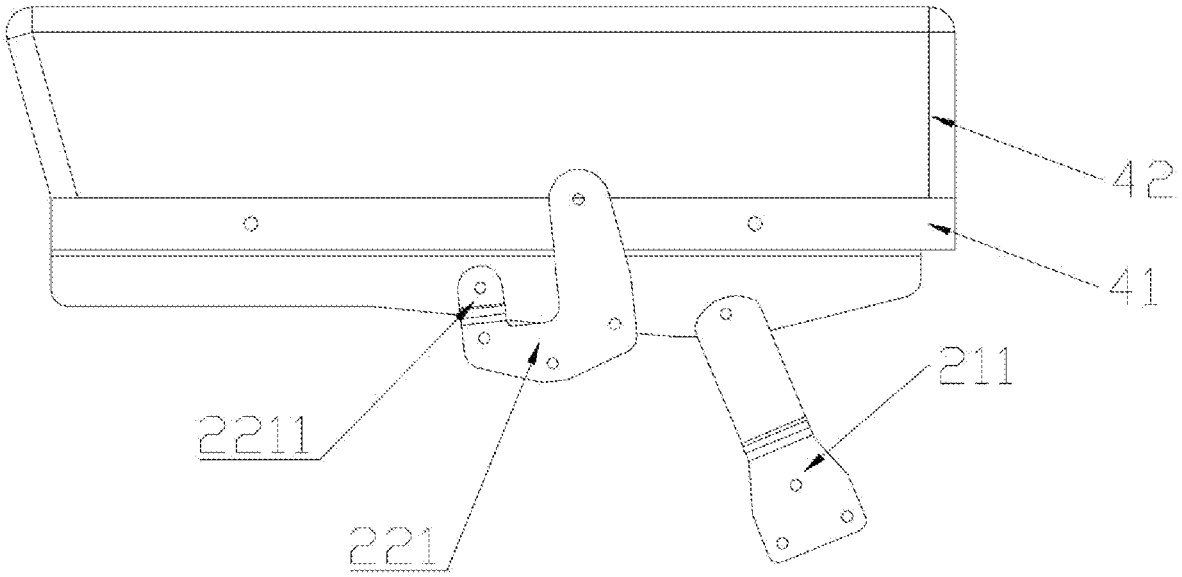
FIG. 8 is a structural diagram of a second sofa base.
Figure 9:
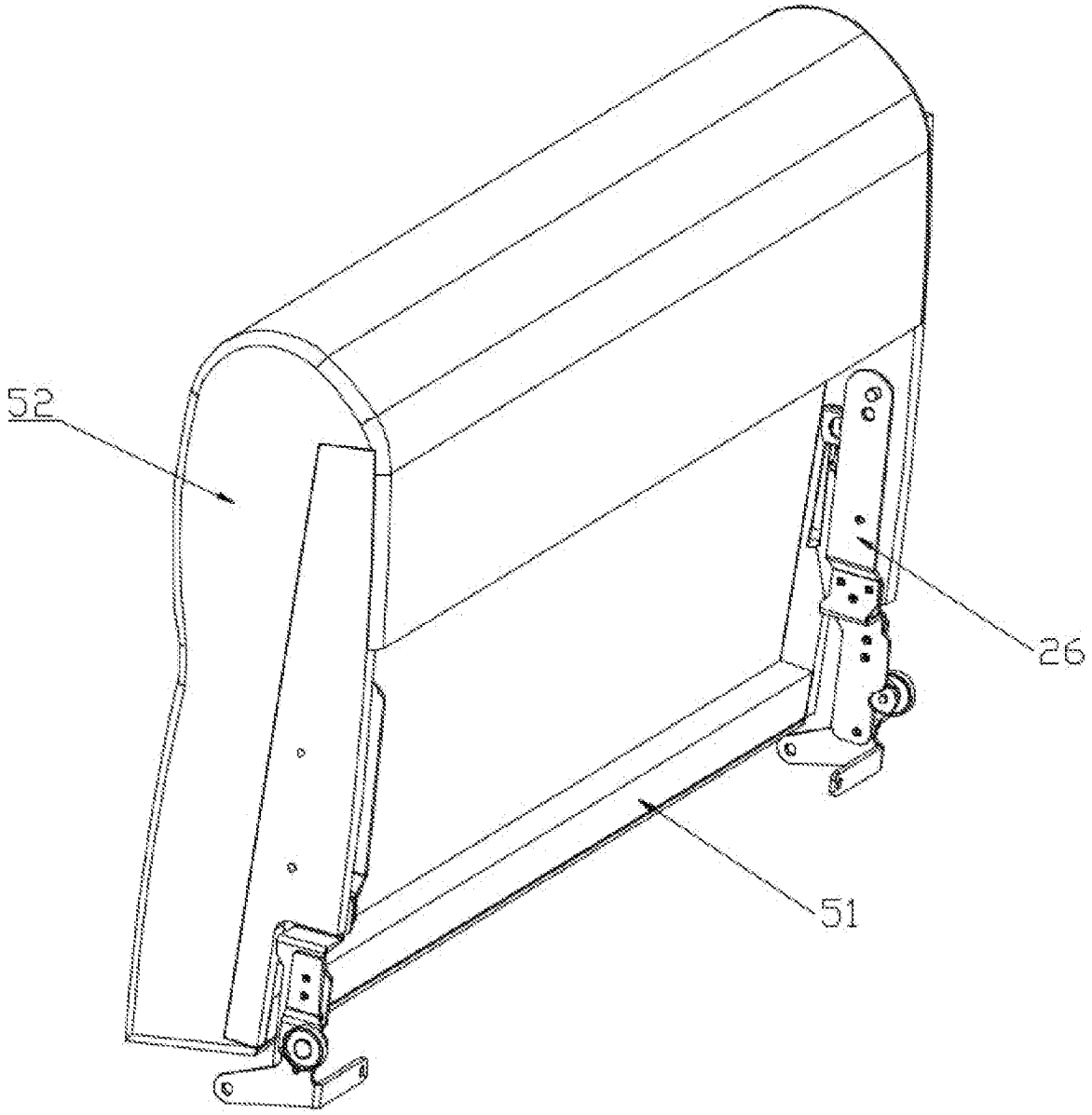
FIG. 9 is a structural diagram of a backrest.

As shown in FIGS. 1 to 9, a zero-wall trifold sofa bed includes sofa base 1. The sofa base is provided with two symmetrical folding assemblies 2. The folding assemblies each include first long arm 21 and second long arm 22 that are pivoted to a front side of an inner wall of an armrest box of the sofa base. A front side of the inner wall of the armrest box of the sofa base is provided with first base 11 that is pivoted to the first long arm and the second long arm. The first long arm is pivoted to a front side of the first base, and the second long arm is pivoted to a middle part of the first base. A front end of the first long arm and a front end of the second long arm are jointly pivoted to first assembly element 23. The first assembly element is configured to assemble the first sofa base 3. The first sofa base includes first frame 31 fixedly connected to the first assembly element. A top part of the first frame is provided with first cushion 32. A front side of the first frame is provided with support element 33. The support element is a support plate for supporting the first frame after the first frame is unfolded. A middle part of the first long arm is fixedly connected to first short arm 211. A middle part of the second long arm is fixedly connected to U-shaped element 221. The U-shaped element includes a lower end that forms second short arm 2211 and a higher end that forms third short arm 2212. The first short arm and the second short arm are jointly pivoted to second assembly element 24. The second assembly element is configured to assemble the second sofa base 4. The second sofa base includes second frame 41 fixedly connected to the second assembly element. A top part of the second frame is provided with second cushion 42. An outer wall of a front side of the first assembly element is provided with first limit pin 231. An outer wall of a back side of the first assembly element is provided with second limit pin 232. The first long arm is provided with first limit surface 212 and second limit surface 213. The second long arm is provided with third limit surface 222. The first limit pin is abutted against the first limit surface to prevent the first sofa base from sinking, thereby improving the stability of the folding assemblies when the folding assemblies are folded. The second limit pin is abutted against the second limit surface to prevent the first assembly element from rotating, thereby improving the stability of the folding assemblies when the folding assemblies are unfolded. The third short arm is pivoted to one end of connecting rod 25, and the other end of the connecting rod is pivoted to third assembly element 26. The third assembly element is configured to assemble backrest 5. The backrest includes backrest frame 51 fixedly connected to the third assembly element. A top part of the backrest frame is provided with backrest cushion 52. The other end of the third assembly element is pivoted to one end of pull rod 27, and the other end of the pull rod is pivoted to second base 12. The second base is provided at a back side of the inner wall of the armrest box of the sofa base. The pull rod is provided with recess 271 for avoiding the backrest. A side of the third assembly element close to the pull rod is provided with third limit pin 261. A sidewall of the recess forms fourth limit surface 2711. The third limit pin is abutted against the fourth limit surface to prevent the third assembly element from rotating, thereby improving the stability of the backrest after the backrest is laid flat. A side of the third assembly element close to the connecting rod is provided with roller 262. The inner wall of the armrest box of the sofa base is provided with guide rail 13. The guide rail is provided with horizontal sliding groove 131 for the roller to slide. A tail end of the first long arm is provided with first hanging pin 214. A tail end of the first base is provided with second hanging pin 111. First tension spring 28 is provided between the first hanging pin and the second hanging pin. A position of the pull rod close to the recess is provided with third hanging pin 272. The third assembly element is bent to form support leg 263. Second tension spring 29 is provided between the support leg and the third hanging pin. When the sofa is converted into a bed, the first tension spring and the second tension spring are stretched to provide a certain resistance, allowing the first sofa base to fall smoothly and safely. When the sofa is converted into a bed, the first tension spring and the second tension spring provide tension and a certain amount of support for the first long arm and the second long arm, thereby improving the stability of the folding mechanism after unfolding. When the bed is converted into a sofa, the first tension spring and the second tension spring are contracted, providing assistance for the first sofa base and the second sofa base to fold backwards. In this way, the first sofa base and the second sofa base can be folded backwards easily.

A specific working process and principle of the present disclosure are as follows. When the sofa is converted into a bed, the first sofa base is folded outward. The first assembly element drives the first long arm and the second long arm to swing outward, and the first short arm and the second short arm support the second sofa base. The third short arm pulls the connecting rod, and the connecting rod pulls the third assembly element. The roller slides forwards inside the horizontal sliding groove, causing the backrest to be flattened and spliced with the first sofa base and the second sofa base to form a bed. When the bed is restored to a sofa, the first sofa base is folded inward. The first assembly element drives the first long arm and the second long arm to swing inward. The first short arm and the second short arm swing inward to drive the second sofa base back to its original position. The third short arm drives the third assembly element through the connecting rod. The roller moves backwards inside the horizontal sliding groove. The tail end of the third assembly element is tilted upwards under the action of the pull rod until it is fully reset. The present disclosure features easy operation and high stability. The sofa base can be placed against a wall to improve space utilization and room layout aesthetics.

What is claimed is:

1. A zero-wall trifold sofa bed, comprising a sofa base, wherein the sofa base is provided with two symmetrical folding assemblies; each of the two symmetrical folding assemblies comprises a first long arm and a second long arm, wherein the first long arm and the second long arm are pivoted to a front side of an inner wall of an armrest box of the sofa base; the first long arm and the second long arm are jointly pivoted to a first assembly element for assembling a first sofa base; a middle part of the first long arm is provided with a first short arm; a middle part of the second long arm is provided with a second short arm and a third short arm; the first short arm and the second short arm are jointly pivoted to a second assembly element for assembling a second sofa base; the third short arm is pivoted to a first end of a connecting rod, and a second end of the connecting rod is pivoted to a first end of a third assembly element for assembling a backrest; a second end of the third assembly element is pivoted to a first end of a pull rod, and a second end of the pull rod is pivoted to a back side of the inner wall of the armrest box of the sofa base; a side of the third assembly element adjacent to the connecting rod is provided with a roller; and the inner wall of the armrest box of the sofa base is provided with a horizontal sliding groove for the roller to slide.

2. The zero-wall trifold sofa bed according to claim 1, wherein the front side of the inner wall of the armrest box of the sofa base is provided with a first base, wherein the first base is pivoted to the first long arm and the second long arm; and the back side of the inner wall of the armrest box of the sofa base is provided with a second base, wherein the second base is pivoted to the pull rod.

3. The zero-wall trifold sofa bed according to claim 2, wherein a first tension spring is provided between a tail end of the first base and a tail end of the first long arm; and a second tension spring is provided between a front part of the pull rod and a front part of the third assembly element.

4. The zero-wall trifold sofa bed according to claim 1, wherein the pull rod is provided with a recess for avoiding the backrest.

5. The zero-wall trifold sofa bed according to claim 1, wherein an outer wall of a front side of the first assembly element is provided with a first limit pin; an outer wall of a back side of the first assembly element is provided with a second limit pin; the first long arm is provided with a first limit surface matched with the first limit pin and a second limit surface matched with the second limit pin; and the second long arm is provided with a third limit surface matched with the second limit pin.

6. The zero-wall trifold sofa bed according to claim 2, wherein a side of the third assembly element adjacent to the pull rod is provided with a third limit pin; and the pull rod is provided with a fourth limit surface matched with the third limit pin.

7. The zero-wall trifold sofa bed according to claim 1, wherein the first sofa base comprises a first frame fixedly connected to the first assembly element; a top part of the first frame is provided with a first cushion; the second sofa base comprises a second frame fixedly connected to the second assembly element; a top part of the second frame is provided with a second cushion; the backrest comprises a backrest frame fixedly connected to the third assembly element; and a top part of the backrest frame is provided with a backrest cushion.

8. The zero-wall trifold sofa bed according to claim 7, wherein a front side of the first frame is provided with a support element.

* * * * *